US007581985B2

(12) United States Patent
Sakamoto

(10) Patent No.: US 7,581,985 B2
(45) Date of Patent: Sep. 1, 2009

(54) CONNECTOR

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/260,136

(22) Filed: Oct. 29, 2008

(65) Prior Publication Data

US 2009/0117778 A1 May 7, 2009

(30) Foreign Application Priority Data

Nov. 6, 2007 (JP) ..... 2007-288290

(51) Int. Cl.
*H01R 13/73* (2006.01)

(52) U.S. Cl. ..... 439/566; 439/571

(58) Field of Classification Search ..... 439/78, 439/563–571, 101

See application file for complete search history.

(56) References Cited

U.S. PATENT DOCUMENTS 4,449,165 A * 5/1984 Kaufman ..... 361/723
5,395,265 A * 3/1995 DiMondi et al. ..... 439/553
5,419,713 A * 5/1995 Northey ..... 439/567
5,704,807 A * 1/1998 Sherman et al. ..... 439/570
6,042,398 A * 3/2000 Wu et al. ..... 439/101
6,053,767 A * 4/2000 Copper et al. ..... 439/567
7,481,657 B2 * 1/2009 Ng et al. ..... 439/78

FOREIGN PATENT DOCUMENTS

JP 2006-031944 A 2/2006

* cited by examiner

*Primary Examiner*—Michael C Zarroli
(74) *Attorney, Agent, or Firm*—Sughrue Mion, PLLC

(57) ABSTRACT

A connector includes a connector housing which has a pair of side walls, a plurality of terminals which are accommodated in the connector housing, and a pair of metal fixing members. Each metal fixing members includes a board fixing portion and a housing mounting portion. Slots are formed in the side walls. Each housing mounting portion is inserted into each slot from the lower side thereof. The each slot has an upper portion and a lower portion smaller in width than the upper portion. The each slot has a pair of retaining step portions. The each housing mounting portion has a pair of arms. Hooks are formed on upper end portions of the arms. When the housing mounting portion is inserted into the slot, the hooks are engaged with the retaining step portions. A convex portion is formed on an inner wall of the slot.

4 Claims, 5 Drawing Sheets

CONNECTOR

BACKGROUND

This invention relates to a connector which is adapted to be mounted on a surface of a board by soldering metal fixing members (secured respectively to opposite ends of a connector housing) to the board.

FIG. 5 shows a conventional surface mounting-type connector disclosed in Patent Literature 1. This surface mounting-type connector includes a connector housing 101 of a generally rectangular box-shape made of an insulative resin and adapted to be placed on a board 110, and metal fixing members 103 which are press-fitted to mounting portions 102 (formed respectively on outer surfaces of side walls of the connector housing 101) from their upper side to be fixed respectively to the side walls of the connector housing 101.

The fixing metal member 103 is formed by bending a strip-like metal plate (or sheet) into a generally L-shaped cross-section, and includes a board fixing portion 103*a* adapted to be soldered to the surface of the board 110, and a housing mounting portion 103*b* extending in an upstanding condition relative to the board fixing portion 103*a* and adapted to be attached to the mounting portion 102 of the connector housing 101. The surface mounting-type connector of FIG. 5 can be mounted on the board 110 by soldering the board fixing portions 103*a* of the metal fixing members 103 to the board 110.

FIGS. 6A and 6B show another conventional surface mounting-type connector, and FIG. 6A is a top plan view, and FIG. 6B is a bottom view. In this surface mounting-type connector, metal fixing members 153 are press-fitted respectively to opposite side walls (or end walls) of a connector housing 151 (having terminals 152 mounted thereon) from the lower side.

[Patent Literature 1] JP-A-2006-31944

In the conventional connector of FIG. 5 in which the metal fixing members 103 are press-fitted respectively to the side walls of the connector housing 101 from their upper side, there is encountered a problem that the overall outer size of the connector is increased since the mounting portions 102 are formed respectively on the outer surfaces of the side walls of the connector housing 101.

In the conventional connector of FIG. 6 in which the metal fixing members 153 are merely press-fitted to the respective side walls from the lower side of the connector housing 151, there is encountered a problem that each fixing metal member 153 is liable to be withdrawn from the connector housing 151, and a retaining force for retaining the fixing metal member 153 is low.

SUMMARY

This invention has been made in view of the above circumstances, and an object of the invention is to provide a connector in which an outer size of a connector housing is prevented from increasing, and also metal fixing members inserted into the connector housing from the lower side can be positively prevented from withdrawal.

In order to achieve the above object, according to the present invention, there is provided a connector comprising:

a connector housing which has a pair of side walls, wherein slots are formed in the side walls respectively and extend upwardly from the lower side of the side walls;

a plurality of terminals which are accommodated in the connector housing; and a pair of metal fixing members, each of which includes a board fixing portion mounted to a board and a housing mounting portion disposed in an upstanding condition relative to the board fixing portion, wherein the housing mounting portion of each of the metal fixing members is inserted into the slot of each of the side walls from the lower side thereof to fix the metal fixing members to the connector housing;

wherein the slot of each of the side walls has an upper portion and a lower portion which serves as an inlet, the lower portion being smaller in width than the upper portion, and the slot of each of the side walls having a pair of retaining step portions formed at a width-changed portion thereof;

wherein the housing mounting portion of each of the metal fixing members has a pair of arms at a tipping end thereof so as to have a slit therebetween;

wherein hooks projecting outwardly are formed on upper end portions of the arms so that a dimension between outer edges of the arms is greater than the width of the lower portion of the slot, and when the housing mounting portion is inserted into the slot, the hooks are engaged respectively with the retaining step portions; and wherein a convex portion is formed on an inner wall of the slot so as to prevent the arms from being resiliently deformed inwardly after the housing mounting portion is inserted into the slot.

Preferably, the pair of arms has resiliently. When the arms are inserted into the slot, the arms are resiliently deformed inwardly so as to allow the hooks to pass through the lower portion of the slot. After the hooks pass through the lower portion of the slot, the arms are restored from their inwardly-deformed condition, so that the hooks are brought into engagement with the retaining step portions, respectively.

Preferably, When the hooks of the pair of arms pass through the lower portion of the slot while the arms are resiliently deformed inwardly, the upper end portions of the arms slide onto a front end portion of the convex portion. When the arms are restored from their inwardly-deformed condition after the hooks pass through the lower portion of the slot, the slit of the arms is opened and the convex portion is fitted in the slit.

Here, it is preferable that when the hooks of the pair of arms pass through the lower portion of the slot while the arms are resiliently deformed inwardly, the upper end portions of the arms slide onto the front end portion of the convex portion while the upper end portions of the arms bend in a direction of a thickness of the arms.

In the connector of the above configurations, the fixing metal member can be fixed to the connector housing against withdrawal by inserting its housing mounting portion into the slot formed in the connector housing. Namely, when the housing mounting portion of the fixing metal member is inserted into the slot, first, the left and right arms are resiliently deformed inwardly, and the hooks pass through the inlet portion of the slot. At this time, the upper end portions of the inwardly-deformed arms are caused to slide onto the front end portion of the convex portion while the arms are resiliently bent in the direction of the thickness thereof or the side wall of the connector housing is resiliently bent by the convex portion formed on the inner wall of the slot. Then, when the arms are restored from the resiliently-deformed condition upon passage of the hooks through the inlet portion of the slot, the hooks are brought into engagement with the respective retaining step portions of the slot, and at the same time the convex portion is fitted into the fully-open slit in the housing mounting portion, and the convex portion prevents the arms from being resiliently deformed inwardly.

Thus, when the hooks are engaged respectively with the retaining step portions, the fixing metal member is prevented from being withdrawn from the housing, and the convex portion is fitted in the slit to prevent the arms from being resiliently deformed inwardly, and therefore the hooks are prevented from being disengaged form the respective retaining step portions, and the fixing metal member is retained in a double manner. As a result, even when a load tending to withdraw the fixing metal member acts thereon, the withdrawal of the fixing metal member can be positively prevented thanks to the provision of the convex portion. In this case, the slots are formed respectively in the opposite side walls of the connector housing which respectively form the opposite end surfaces of this connector housing, and the convex portion is formed on the inner wall of the slot, and therefore the outer size of the connector housing can be prevented from increasing.

In the connector of the above configurations, the arms are resiliently deformed inwardly during the passage of the hooks through the inlet portion of the slot, and the upper end portions of the thus deformed arms are also resiliently bent in the direction of their thickness (plate thickness), and are caused to slide onto the front end portion of the convex portion. Thus, the housing mounting portion (more specifically, the arms) can be bent in the direction of the thickness thereof, and therefore a compact design of the connector housing can be achieved, and besides the side walls of the connector housing do not need to be particularly elastic (that is, the rigidity of the side walls does not need to be lowered).

In the present invention, the outer size of the connector can be prevented from increasing, and besides the metal fixing members inserted into the side walls of the connector housing from the lower side can be positively prevented from withdrawal.

The present invention has been briefly described above. Details of the invention will become more manifest upon reading the following Section "Best Mode for Carrying Out the Invention" with reference to the accompanying drawings.

BRIEF DESCRIPTION OF THE DRAWINGS

The above objects and advantages of the present invention will become more apparent by describing in detail preferred exemplary embodiments thereof with reference to the accompanying drawings, wherein:

FIG. 2A is a cross-sectional view through a plane disposed centrally of a width of the slot, and FIG. 2B is a cross-sectional view taken along the line IIb-IIb of FIG. 2A, and FIG. 2C is a cross-sectional view taken along the line IIc-IIc of FIG. 2A;

FIG. 3A is a view similar to FIG. 2A, and FIG. 3B is a cross-sectional view taken along the line IIIb-IIIb of FIG. 3A, and FIG. 3C is a cross-sectional view taken along the line IIIc-IIIc of FIG. 3A;

FIG. 4A is a view similar to FIG. 2A, and FIG. 4B is a cross-sectional view taken along the line IVb-IVb of FIG. 4A, and FIG. 4C is a cross-sectional view taken along the line IVc-IVc of FIG. 4A;

DETAILED DESCRIPTION OF EXEMPLARY EMBODIMENTS

A preferred embodiment of the present invention will now be described in detail with reference to the drawings.

Figure 1:
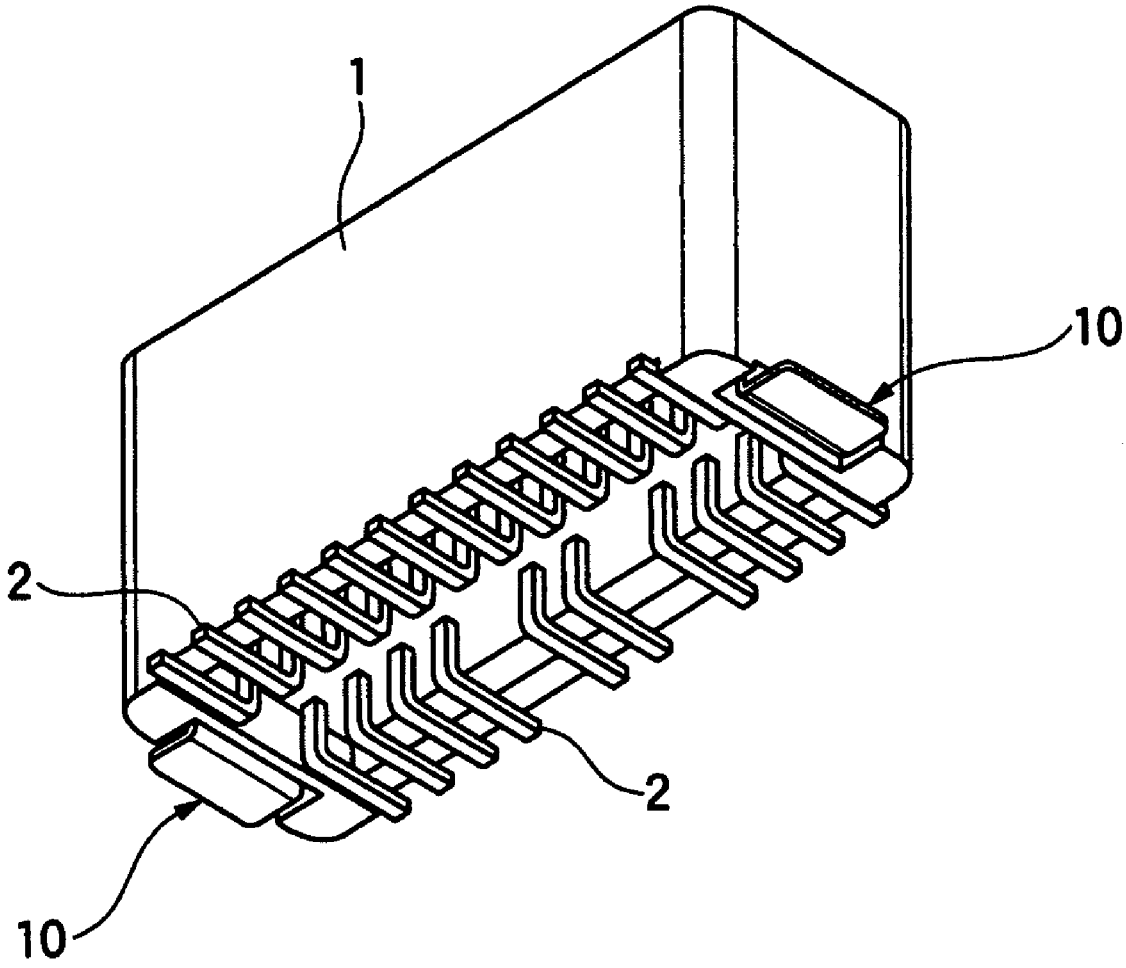
FIG. 1 is a perspective view of a surface mounting-type connector according to one preferred embodiment of the present invention as seen from the lower side.
Figure 2A:
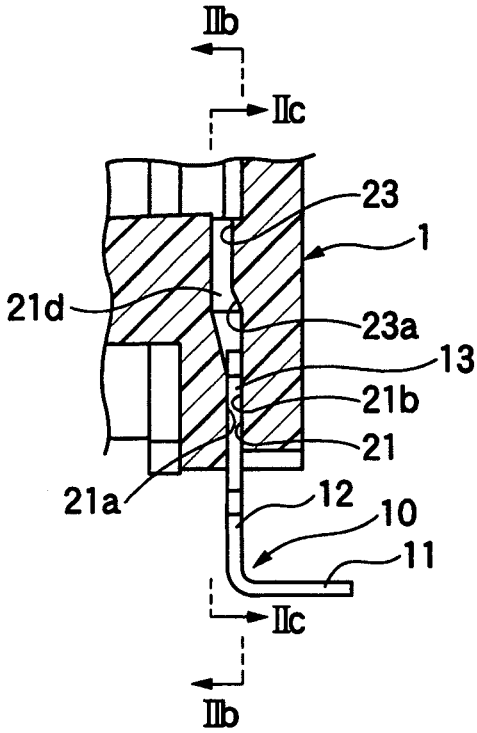
FIGS. 2A to 2C show a first step of a process of inserting a fixing metal member into a slot in the connector.
Figure 2B:
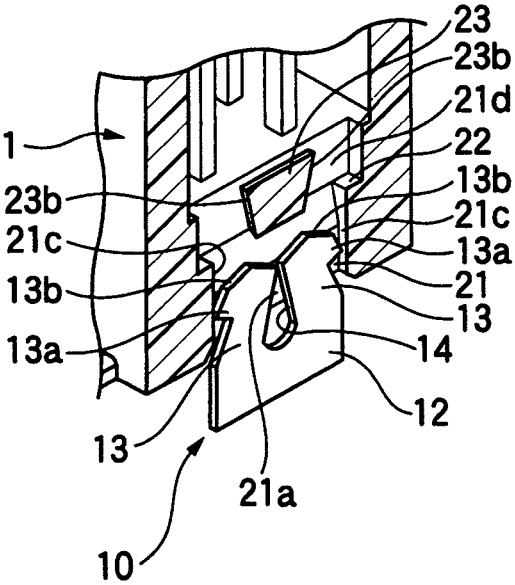
Figure 2C:
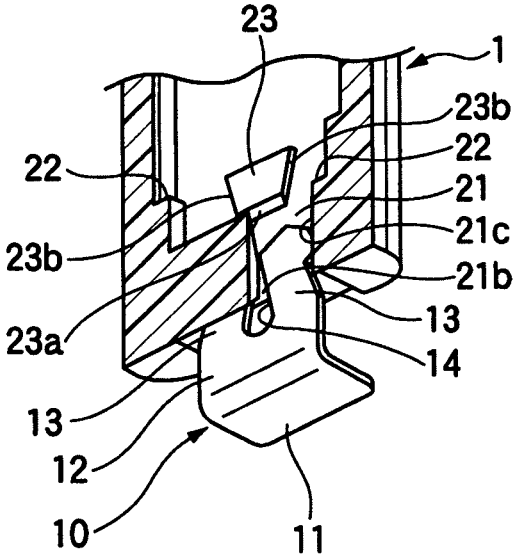
Figure 3A:
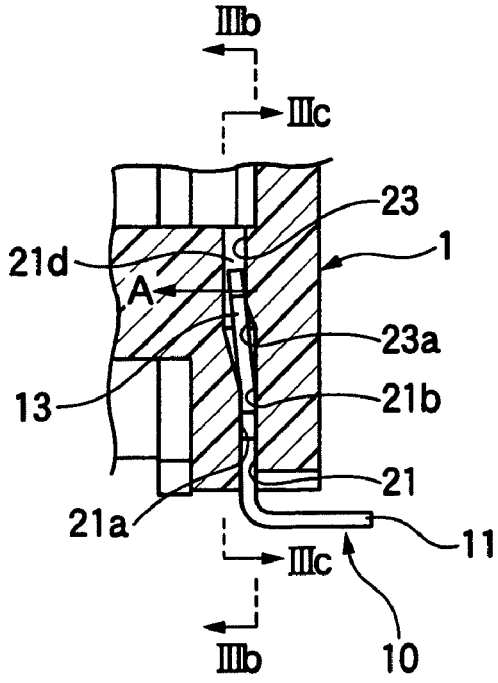
FIGS. 3A to 3C show a second step of the above inserting process.
Figure 3B:
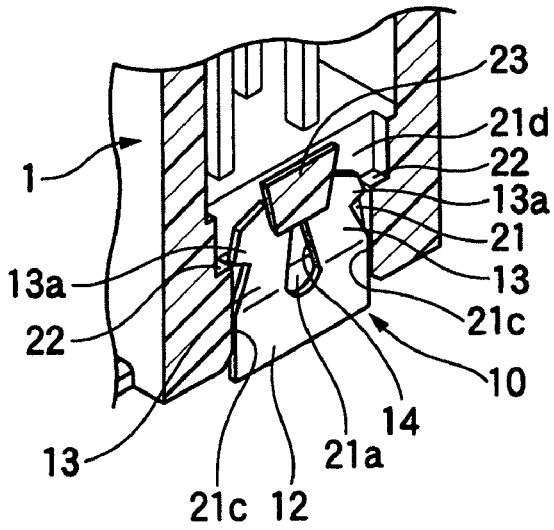
Figure 3C:
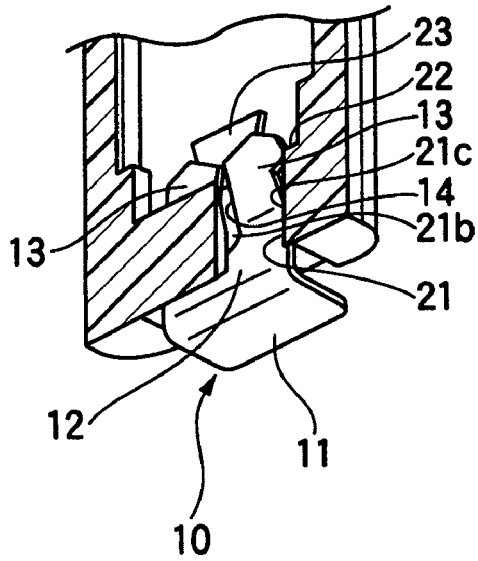
Figure 4A:
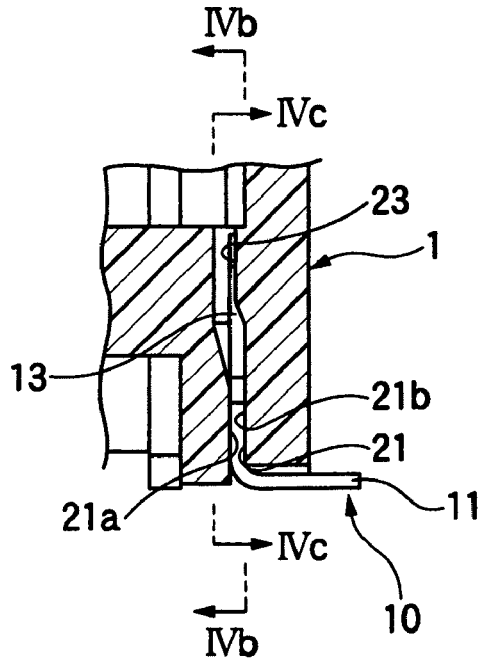
FIGS. 4A to 4C shown a final step of the above inserting process.
Figure 4B:
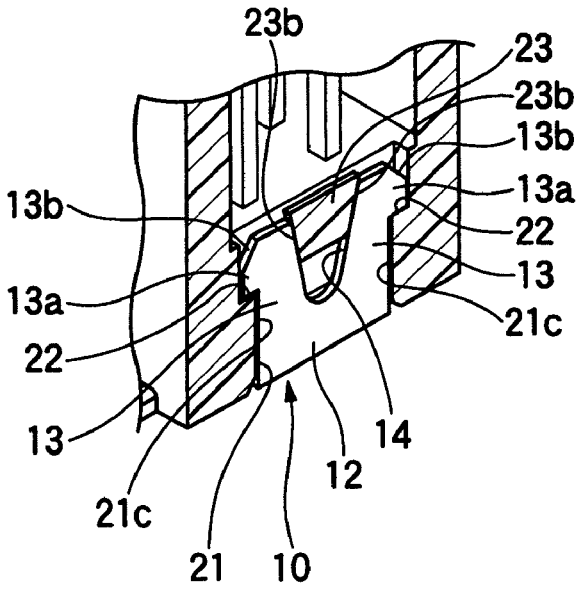
Figure 4C:
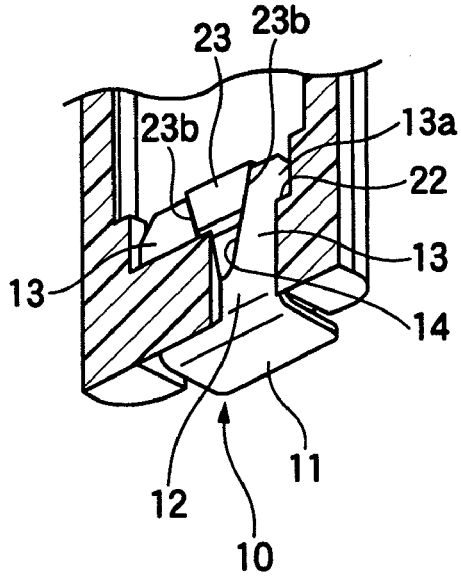
Figure 5:
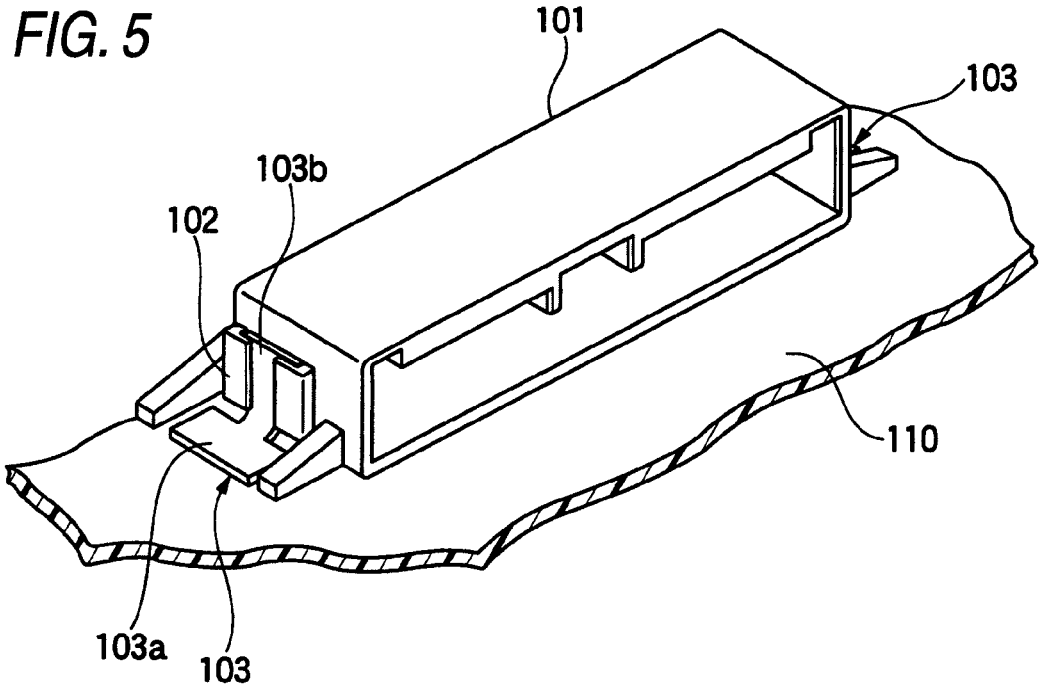
FIG. 5 is a perspective view of a conventional connector.
Figure 6A:
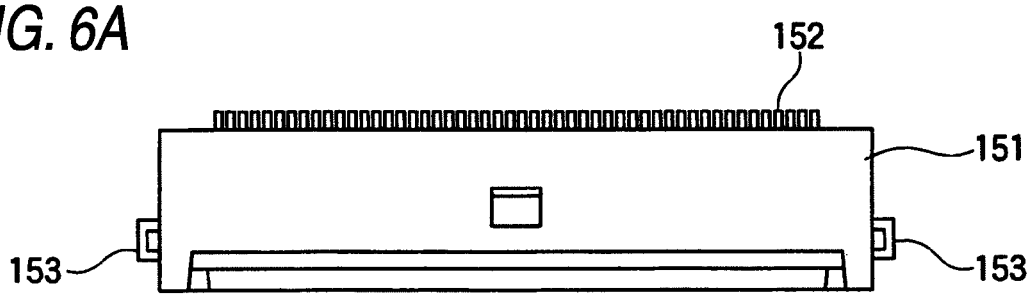
FIGS. 6A and 6B are a top plan view and a bottom view of another conventional connector, respectively.
Figure 6B:
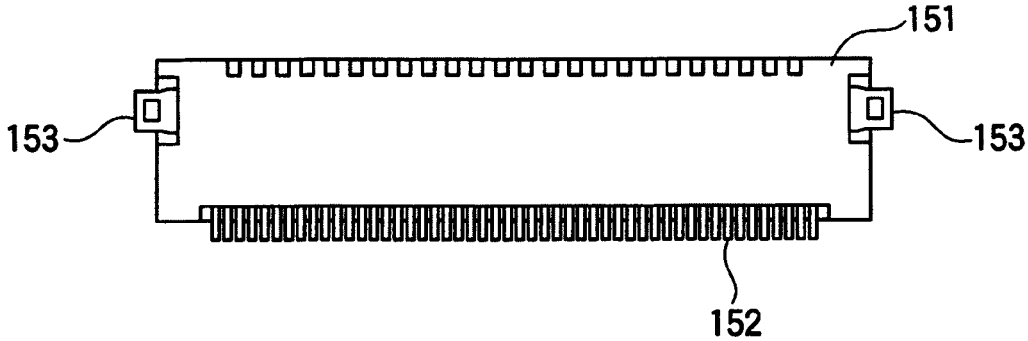

FIG. 1 is a perspective view of one preferred embodiment of a connector of the invention as seen from the lower side. FIGS. 2 to 4 sequentially show the steps of a process of inserting a fixing metal member into a slot. FIG. 2A is a cross-sectional view through a plane disposed centrally of a width of the slot, and FIG. 2B is a cross-sectional view taken along the line IIb-IIb of FIG. 2A, and FIG. 2C is a cross-sectional view taken along the line IIc-IIc of FIG. 2A. FIG. 3A is a view similar to FIG. 2A, and FIG. 3B is a cross-sectional view taken along the line IIIb-IIIb of FIG. 3A, and FIG. 3C is a cross-sectional view taken along the line IIIc-IIIc of FIG. 3A. FIG. 4A is a view similar to FIG. 2A, and FIG. 4B is a cross-sectional view taken along the line IVb-IVb of FIG. 4A, and FIG. 4C is a cross-sectional view taken along the line IVc-IVc of FIG. 4A.

As shown in FIG. 1, the surface mounting-type connector of this embodiment includes a connector housing 1 molded of an insulative resin, a plurality of terminals 2 mounted on the connector housing 1, a pair of metal fixing members 10 mounted respectively on opposite end portions of a lower surface of the connector housing 1. The surface mounting-type connector can be mounted on a surface of a board by soldering the metal fixing members 10 to the board.

As shown in FIGS. 2A to 2C, slots 21 are formed respectively in opposite side walls of the connector housing 1 provided respectively at the opposite ends thereof, each slot 21 extending upwardly from the lower surface of the connector housing 1 (which is to face the board (not shown)). The plurality of terminals 2 are mounted on that portion of the connector housing 1 lying between the opposite side walls of the connector housing 1.

The fixing metal member 10 is formed by bending a strip-like metal plate (or sheet) into a generally L-shape cross-section, and includes a board fixing portion 11 adapted to be soldered to the surface of the board, and a housing mounting portion 12 extending from the board fixing portion 11 via a perpendicularly-bent portion in upstanding relation to the board fixing portion 11 and inserted into the slot 21 from the lower side to be fixed to the connector housing 1.

The slot 21 has a lower inlet portion smaller in width than an upper portion thereof such that the slot 21 has retaining step portions 22 formed at a width-changed portion thereof. Namely, the inlet portion of the slit 21 is in the form of a rectangular hole defined by opposed inner and outer walls 21*a* and 21*b* of a larger width and left and right side walls 21*c*, and a dimension between the left and right side walls 21*c* is slightly larger than the width of the housing mounting portion 12 of the fixing metal member 10, and a width of the upper portion of the slot 21 above the inlet portion is larger than the width of this inlet portion.

A slit 14 is formed in a widthwise-central portion of the housing mounting portion 12 of the fixing metal member 10, and extends from an upper edge (or upper end) of the housing mounting portion 12 toward the bent portion such that the housing mounting portion 12 is generally divided to form a pair of left and right arms 13 and 13. Hooks 13 are formed on and project outwardly respectively from upper end portions of the two arms 13 such that a dimension between outer edges of the two arms 13 facing away from each other is larger than the width of the inlet portion of the slot 21. When the housing mounting portion 12 is inserted into the slot 21, the hooks 13*a* are engaged respectively with the retaining step portions 22, thereby preventing the fixing metal member 10 from downward withdrawal. Chamfered portions 13*b* are formed respectively at outer corner portions of the upper edges of the arms 13 so as to facilitate the insertion of the arms 13 into the inlet portion of the slot 21.

The pair of left and right arms 13, when inserted into the slot 21, are resiliently deformed inwardly (that is, toward each other) so as to allow the hooks 13*a* to pass through the inlet portion of the slot 21, and after the hooks 13*a* pass through the inlet portion of the slot 21, the two arms 13 are restored from their inwardly-deformed condition, so that the two hooks 13*a* are brought into engagement with the respective retaining step portions 22.

A convex portion 23 is formed on the outwardly-disposed inner wall (extension wall of the wall 21*b*) of the slot 21. When the pair of left and right arms 13, while resiliently deformed inwardly so as to pass the hooks 13*a* through the inlet portion of the slot 21, advance in the slot 21, the convex portion 23 resiliently bends the arms 13 in the direction of the thickness (plate thickness) thereof so as to cause the upper end portions of the arms 13 to slide onto a front end portion of the convex portion 23 as shown in FIGS. 3A to 3C. Subsequently, when the arms 13 are restored from their resiliently-deformed condition upon passage of the hooks 13*a* through the inlet portion of the slot 21, the slit 14 is opened (that is, restored into its fully open condition), so that the convex portion 23 is fitted in this slit 14, thereby preventing the arms 13 from being resiliently deformed inwardly, as shown in FIGS. 4A to 4C. A lower end or edge 23*a* of the convex portion 23 is formed into an inclined surface for guiding the sliding movement of the arms 13 onto the convex portion 23. Left and right side edges 23*b* serve as engagement surfaces for engagement respectively with the inner side edges of the arms 13. A space 21*d* for allowing the arms 13 to be resiliently bent in the direction of the thickness thereof is secured at an inner end portion of the slot 21.

Next, the operation will be described. In this surface mounting-type connector, each fixing metal member 10 can be fixed to the connector housing 1 against withdrawal by inserting the housing mounting portion 12 of the fixing metal member 10 into the slot 21 formed in the connector housing 1.

Namely, when the housing mounting portion 12 of the fixing metal member 10 is inserted into the slot 21, first, the left and right arms 13 are resiliently deformed inwardly as shown in FIGS. 2A to 2C, and the hooks 13*a* pass through the inlet portion of the slot 21. When the housing mounting portion 12 is further inserted, the upper end portions of the inwardly-deformed arms 13 slide onto the convex portion formed on the inner wall of the slot 21 as shown in FIGS. 3A to 3C. Then, when the housing mounting portion 12 is further inserted, the hooks 13*a* pass through the inlet portion of the slot 21, and the arms 13 are restored from the resiliently-deformed condition, and therefore the hooks 13*a* are brought into engagement with the respective retaining step portions 22 of the slot 21, and at the same time the convex portion 23 on the connector housing 1 is fitted into the fully-open slit 14 in the housing mounting portion 12, and the left and right side edges 23*b* of the convex portion 23 abut respectively against the inner edges of the arms 13, thereby preventing the arms 13 from being resiliently deformed inwardly.

Thus, when the hooks 13*a* are engaged respectively with the retaining step portions 22, the fixing metal member 10 is prevented from being withdrawn from the slot 21 in the connector housing 1, and the convex portion 23 is fitted in the slit 14 to prevent the arms 13 from being resiliently deformed inwardly, and therefore the hooks 13*a* are prevented from being disengaged form the respective retaining step portions 22, and the fixing metal member 10 is retained in a double manner. As a result, even when a load tending to withdraw the fixing metal member 10 acts thereon, the withdrawal of the fixing metal member 10 can be positively prevented thanks to the provision of the convex portion 23.

Furthermore, in the surface mounting-type connector of this embodiment, each slot 21 is formed in the side wall of the connector housing 1, and the convex portion 23 is formed on the inner wall (inner surface) of the slot 21, and therefore the outer size of the connector housing 1 can be prevented from increasing.

Furthermore, in this surface mounting-type connector, the arms 13 are resiliently deformed inwardly during the passage of the hooks 13*a* through the inlet portion of the slot 21, and the upper end portions of the thus deformed arms 13 are also resiliently bent in the direction of their thickness (plate thickness) by the convex portion 23 formed on the inner wall of the slot 21, and are caused to slide onto the front end portion of the convex portion 23. Thus, the housing mounting portion 12 (more specifically, the arms 13) can be bent in the direction of the thickness thereof, and therefore a compact design of the connector housing 1 can be achieved, and besides the side walls of the connector housing 1 do not need to be particularly elastic (that is, the rigidity of the side walls does not need to be lowered).

The present invention is not limited to the above embodiment, and suitable modifications, improvements, etc., can be made. Furthermore, the material, shape, dimensions, number, disposition, etc., of each of the constituent elements of the above embodiment are arbitrary and are not limited in so far as the invention can be achieved.

For example, in the above embodiment, when the pair of left and right arms 13, while resiliently deformed inwardly so as to pass the hooks 13*a* through the inlet portion of the slot 21, advance in the slot 21, the convex portion 23 resiliently bends the arms 13 in the direction of the thickness (plate thickness) thereof so as to cause the upper end portions of the arms 13 to slide onto the front end portion of the convex portion 23. However, instead of this construction, there can be adopted a construction in which when the pair of left and right arms 13, while resiliently deformed inwardly so as to pass the hooks 13*a* through the inlet portion of the slot 21, advance in the slot 21, the convex portion 23 is pressed by the arms 13, so that the outwardly-disposed inner wall of the slot 21 (which is the extension wall of the wall 21*b*, and defines the side wall of the connector housing 1 forming the end surface thereof) is resiliently bent outwardly in the direction of the thickness thereof (plate thickness), thereby allowing the upper end portions of the arms 13 to slide onto the front end portion of the convex portion 23.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2007-288290 filed on Nov. 6, 2007, the contents of which are incorporated herein for reference.

What is claimed is:

1. A connector comprising:

a connector housing which has a pair of side walls, wherein slots are formed in the side walls respectively and extend upwardly from the lower side of the side walls;

a plurality of terminals which are accommodated in the connector housing; and a pair of metal fixing members, each of which includes a board fixing portion mounted to a board and a housing mounting portion disposed in an upstanding condition relative to the board fixing portion, wherein the housing mounting portion of each of the metal fixing members is inserted into the slot of each of the side walls from the lower side thereof to fix the metal fixing members to the connector housing;

wherein the slot of each of the side walls has an upper portion and a lower portion which serves as an inlet, the lower portion being smaller in width than the upper portion, and the slot of each of the side walls having a pair of retaining step portions formed at a width-changed portion thereof;

wherein the housing mounting portion of each of the metal fixing members has a pair of arms at a tipping end thereof so as to have a slit therebetween;

wherein hooks projecting outwardly are formed on upper end portions of the arms so that a dimension between outer edges of the arms is greater than the width of the lower portion of the slot, and when the housing mounting portion is inserted into the slot, the hooks are engaged respectively with the retaining step portions; and wherein a convex portion is formed on an inner wall of the slot so as to prevent the arms from being resiliently deformed inwardly after the housing mounting portion is inserted into the slot.

2. The connector according to claim 1, wherein the pair of arms has resiliently;

wherein when the arms are inserted into the slot, the arms are resiliently deformed inwardly so as to allow the hooks to pass through the lower portion of the slot; and wherein after the hooks pass through the lower portion of the slot, the arms are restored from their inwardly-deformed condition, so that the hooks are brought into engagement with the retaining step portions, respectively.

3. The connector according to claim 1, wherein when the hooks of the pair of arms pass through the lower portion of the slot while the arms are resiliently deformed inwardly, the upper end portions of the arms slide onto a front end portion of the convex portion; and wherein when the arms are restored from their inwardly-deformed condition after the hooks pass through the lower portion of the slot, the slit of the arms is opened and the convex portion is fitted in the slit.

4. The connector according to claim 3, wherein when the hooks of the pair of arms pass through the lower portion of the slot while the arms are resiliently deformed inwardly, the upper end portions of the arms slide onto the front end portion of the convex portion while the upper end portions of the arms bend in a direction of a thickness of the arms.

* * * * *